United States Patent [19]

McQuillan

[11] 4,216,961

[45] Aug. 12, 1980

[54] TABLE BASEBALL APPARATUS

[76] Inventor: Mary J. McQuillan, 44 Hamilton Ter., Georgetown, Mass. 01830

[21] Appl. No.: 931,128

[22] Filed: Aug. 4, 1978

[51] Int. Cl.[3] ..... A63F 7/06; A63F 7/26; A63F 7/28

[52] U.S. Cl. ..... 273/89; 273/120 A; 273/129 Q

[58] Field of Search ..... 273/89, 1 M, 120 R, 273/120 A, 129 F; 124/1

[56] References Cited

U.S. PATENT DOCUMENTS

| | | | |
|---|---|---|---|
| 975,953 | 11/1910 | Hourwich | 124/1 |
| 1,772,116 | 8/1930 | Snodgrass | 273/89 |
| 1,896,684 | 2/1933 | Cutting et al. | 273/89 |
| 2,775,457 | 12/1956 | Galbos | 273/89 |
| 2,829,895 | 4/1958 | Moen | 273/89 X |
| 3,101,197 | 8/1963 | Schultz | 273/89 |
| 3,214,171 | 10/1965 | Luchsinger | 273/1 M X |
| 3,227,452 | 1/1966 | Murphy | 273/89 |
| 3,377,068 | 4/1968 | Schoen | 273/89 |
| 3,706,454 | 12/1972 | Parlato | 273/89 |
| 4,017,074 | 4/1977 | Roberts | 273/89 |

FOREIGN PATENT DOCUMENTS

| | | | |
|---|---|---|---|
| 28300 | of 1904 | United Kingdom | 273/1 M |

*Primary Examiner*—Paul E. Shapiro

[57] ABSTRACT

Apparatus is provided for the playing of a parlor game version of baseball. A playing field of nonferrous material has baseball markings delineated. A pitching mechanism is provided whereby a ferrous metal ball is positioned on the upper surface of the playing field. A first cart, positioned beneath the playing field and out of sight, carries a magnet for the guiding of the ball and is positioned on a first ramp device. A second cart is provided with a relatively heavy weight and positioned on a second ramp, the angle of which is determined by the defensive player of the game. The second cart is attached to the first cart by a string whereby movement of the second cart will affect movement of the first cart. Pitching of the ball is carried out by releasing the second cart and allowing it to roll down the second ramp and pull the first cart along the first ramp. The angle of the first ramp with respect to home plate and the pitcher's mound can be adjusted by the defensive player to control the curve on the ball while the speed of the ball may be adjusted by varying the angle of the second ramp to produce a greater or lesser incline for the second cart to roll down. Mechanical fielders comprising box-like devices having a pivotable front for allowing the ball to roll within the box and also for allowing throwing of the ball by movement of the front about the pivot are provided.

4 Claims, 11 Drawing Figures

TABLE BASEBALL APPARATUS

BACKGROUND OF THE INVENTION

1. Field of the Invention

This invention relates to parlor games for the simulated playing of baseball on a small scale.

2. Description of the Prior Art

Various simulated baseball games are known in the prior art. For instance, U.S. Pat. No. 1,492,127, issued Apr. 29, 1924, to Fox et al, discloses a baseball game apparatus wherein virtually all aspects of a normal game are simulated by mechanical components. This game requires complex mechanical and electrical devices which render the game difficult to use as well as expensive and susceptible to mechanical failure. U.S. Pat. No. 2,230,743, issued Feb. 4, 1941, to Davis, shows a game whereby the player on one team manipulates a puck by use of a magnet and a player on the other team attempts to hit the puck with a bat. This game provides no means for fielding of the puck after it is hit and the manner of pitching differs considerably from the present invention. U.S. Pat. No. 2,631,854, issued Mar. 17, 1953, to Volman, discloses a simulated baseball game wherein a bat is positioned at home plate and the ball is propelled forward by the bat and scoring is counted in accordance with the position at which the ball comes to rest. No pitching device is provided and no fielding devices are used in this game. U.S. Pat. No. 2,694,574, issued Nov. 16, 1954, to Baker, discloses a baseball game device which has a pitching apparatus and a batting apparatus wherein the pitching apparatus does not allow a change of speed of the ball or a means to aim the ball to different sides of the plate. Points are accumulated by the batter in accordance with the final resting position of the ball when hit. No fielding devices are provided as in the present invention. U.S. Pat. No. 2,775,457, issued Dec. 25, 1956, to Galbos, contemplates a simulated baseball game which has a pitching device wherein a ball is rolled toward the simulated home plate and deflections of the ball from a linear course may be produced by a magnet positioned beneath the playing field and operated by the defensive player. The Galbos device affords the offensive player the opportunity to see the direction of initial ball movement from the pitching position. Also, this device does not provide any means for changing the speed of the pitched ball. U.S. Pat. No. 3,091,459, issued May 28, 1963, to Lindman, teaches a magnetic game device which may be used to play a simulated game of baseball wherein magnetic runners are used to score runs in the game. The ball and runners as well as the batter of the device are manipulated by the use of magnets disposed beneath the game board. The manipulation of these magnets by hand would become tiresome as well as complex.

SUMMARY OF THE INVENTION

The present invention contemplates a game device whereby a simulated game of baseball may be played. The device is relatively simple to use, inexpensive to manufacture, yet provides a game whereby the majority of the rules of major league baseball may be applied. Thus, the device provides the excitement of a baseball game played on a small scale.

One object of the present invention is to provide a baseball game device wherein the speed of the pitched ball may be varied by the defensive player. Also, the trajectory of the pitched ball may be varied while the ball is advancing toward the batter. In this manner, simulated curves, fast balls and screw balls may be produced.

An additional object of the present invention is to provide a baseball game device whereby a depression produced behind home plate automatically informs the players if the ball just pitched is a ball or a strike. If the pitched ball drops within the depression, the pitch is termed a strike, whereas if the ball remains outside of the depression, the pitch is termed a ball.

A further object of the present invention is to provide a game device whereby foul balls will be automatically determined by obstacles present on the game board.

Yet a still further object of the present invention is to provide a game device whereby mechanical playing elements are designed to enhance the playability of the game without the necessity of electrical components being incorporated in the apparatus.

One yet still further object of the invention is to provide a baseball game apparatus wherein the bat which the offensive uses has cutout portions so as to enable the batter to swing at and miss a ball thrown to the inside. The bat provided is also movable with respect to home plate so as to allow the offensive player to move the bat about within the confines of the batting box prescribed by the limits of mobility of the bat. In this manner, using a strictly defined bat movable within the batting box, the need for the element of skill in batting is greatly enhanced.

A still further object of the present invention is to provide an auxiliary device for keeping track of the position of any runners on base without the necessity of providing obstacles on the main game board which obstacles may serve to hinder the free progress of the baseball.

Another object of the present invention is to provide a baseball game apparatus which may be operated without the use of electricity or any other auxiliary power source. In this manner, the game will be free from any potential hazards due to electric current and also the game may be played in areas remote from electric power.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
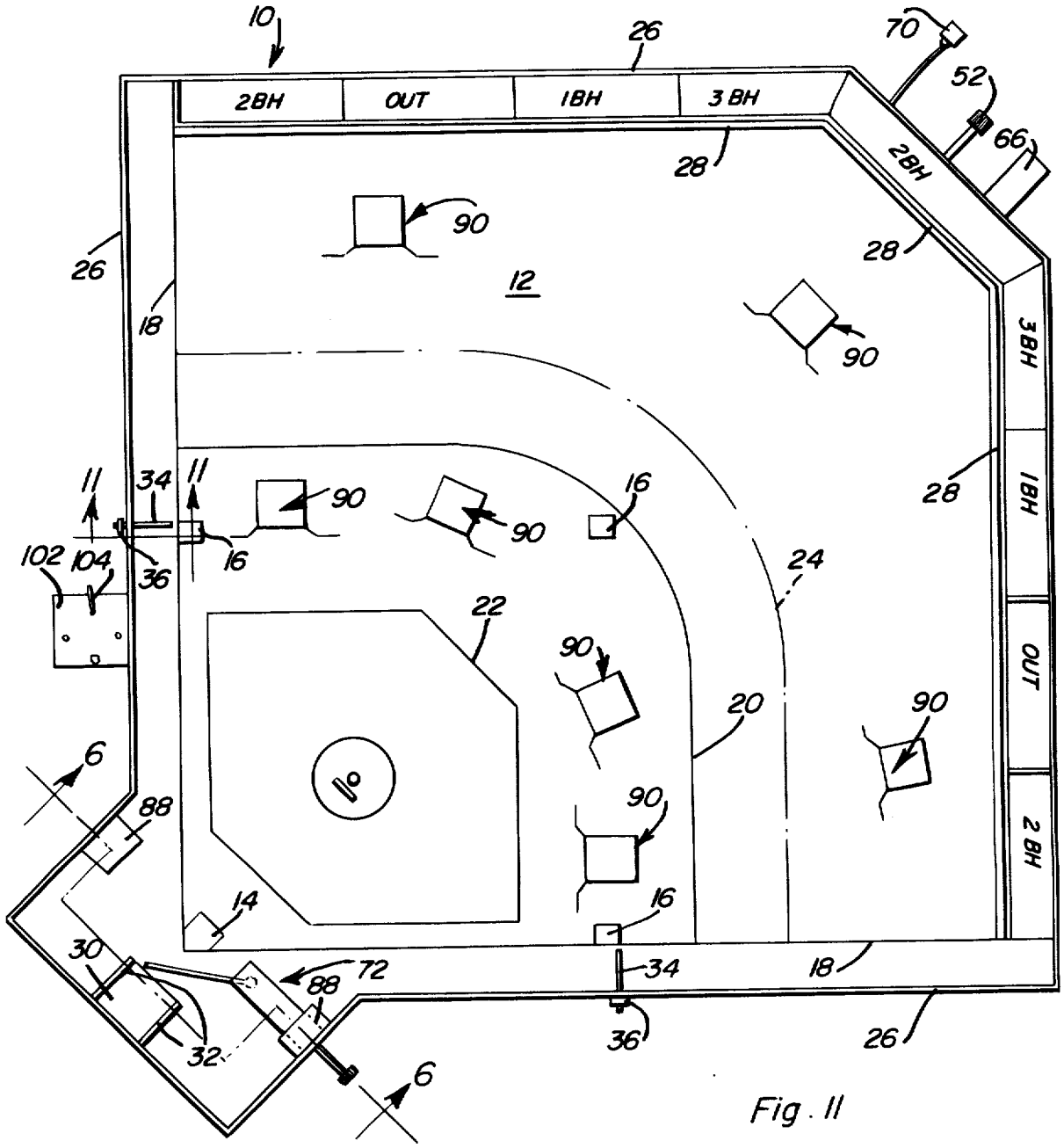
FIG. 1 is a plan view of the game board of the present invention with a batter and fielders in place.

Referring now to the figures, the game apparatus of the present invention is generally referred to by the numeral 10. The apparatus comprises a game board generally labeled 12. This game board is preferably made with a non-magnetic playing surface and is covered with a soft material. The game board includes markings for designating a typical baseball playing field. These markings include home plate 14, bases 16, out of bound lines 18 and infield area 20. Additionally, line 22 is included for designating an infield restricted area within that line and a dotted line 24 for indicating an outfield restricted area. The purpose of these restricted areas will become apparent hereinafter. The game board has wall 26 extending about the entire periphery thereof. In the outfield portion of the game board, a bumper 28 is provided spaced forwardly of the outer wall 26. The space between bumper 28 and wall 26 serves to define the number of bases to be advanced by a player whose batted ball comes to rest therein.

Figure 11:
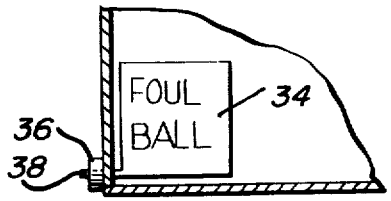
FIG. 11 is an elevational view of a foul ball indicator with portions in section taken substantially along section line 11—11 of FIG. 1.
Figure 6:
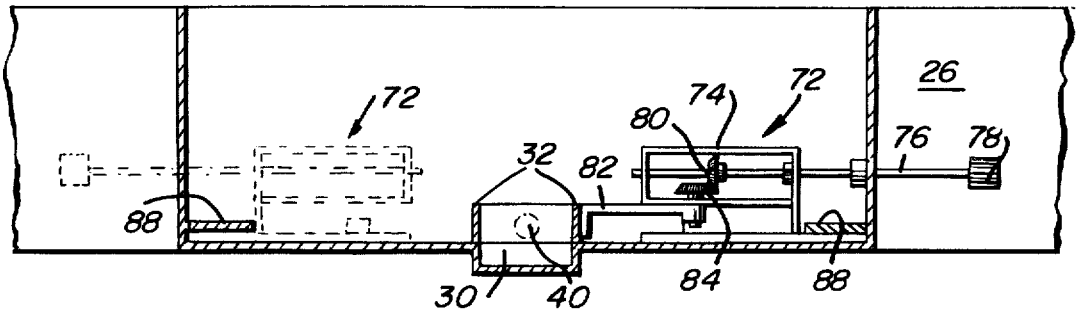
FIG. 6 is an elevational sectional view taken substantially along a plane passing through section line 6—6 of FIG. 1.

Certain features are provided in the game apparatus in order that the functions normally carried on by an umpire in professional baseball may be performed automatically. These include depression 30, as seen in FIGS. 1 and 6, positioned directly behind home plate 14. This depression 30 has the purpose of defining the strike zone for the batter. Any pitched ball which enters directly into depression 30 would be termed a strike, while any pitched ball which remains outside the depression 30 would be called a ball. Additionally, guide walls 32 are positioned above depression 30 in order that a ball may not enter depression 30 unless it has first crossed home plate 14. Foul balls are detected by foul ball marker 34 as shown in FIGS. 1 and 11. One foul ball marker is positioned along each base line so as to indicate that a hit ball is foul if the ball contacts any portion of the foul ball marker. These foul ball markers are removably mounted upon walls 26 of the game board in order that they may be dismounted from the wall during fielding action so as to not interfere with the normal fielding of the baseball as described hereinafter. This removal feature is affected by use of, for example, threaded nuts 36 which attach to a shaft 38 of the foul ball marker which extends through an aperture disposed in the wall 26 therefor. Any other suitable fastening device may be employed as desired.

Figure 2:
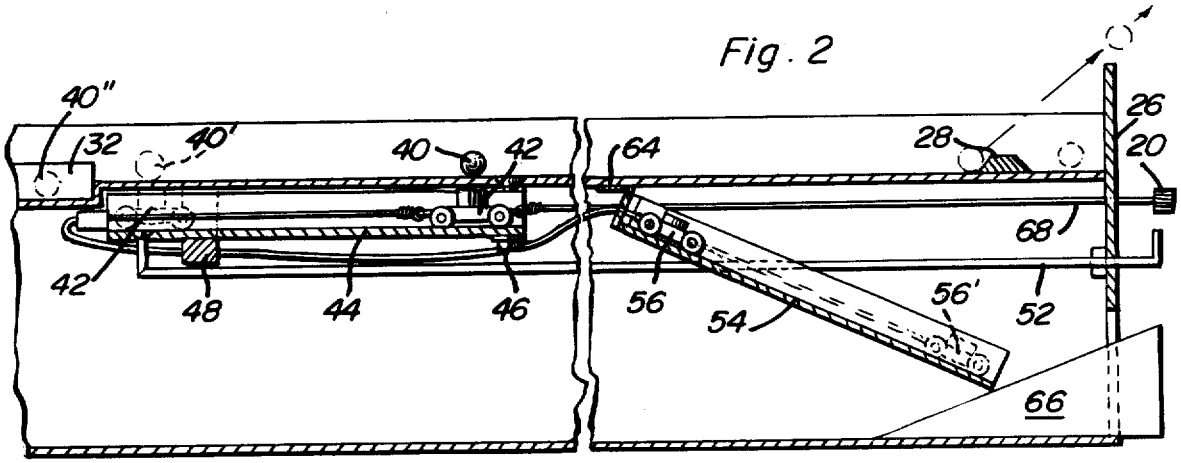
FIG. 2 is a sectional elevational view of the game board showing the pitching device.
Figure 3:
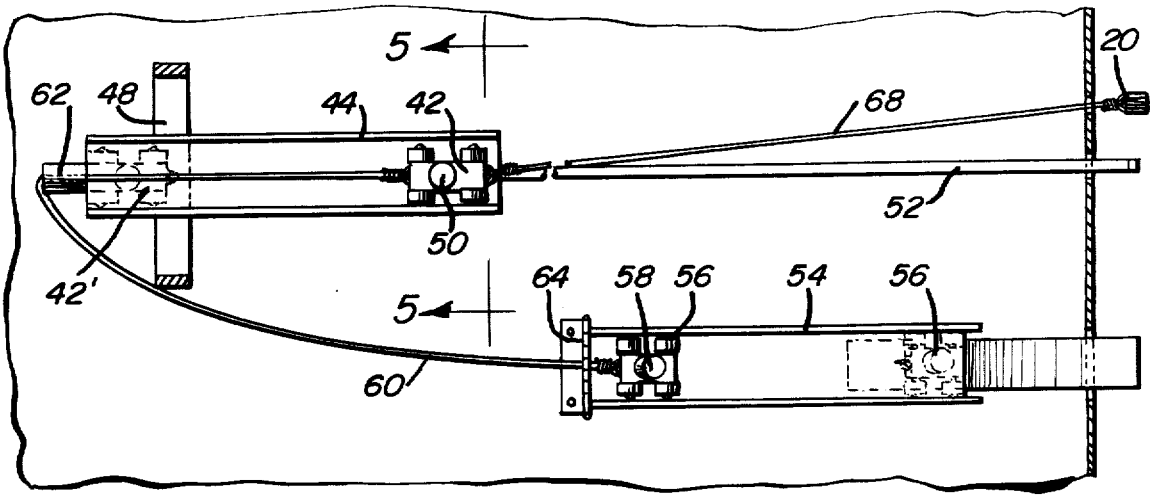
FIG. 3 is a plan sectional view of the game board showing the pitching device.
Figure 4:
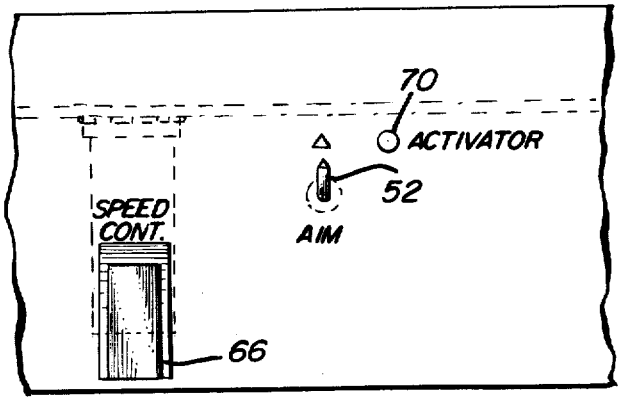
FIG. 4 is an enlarged view of the control panel for the pitching device.
Figure 5:
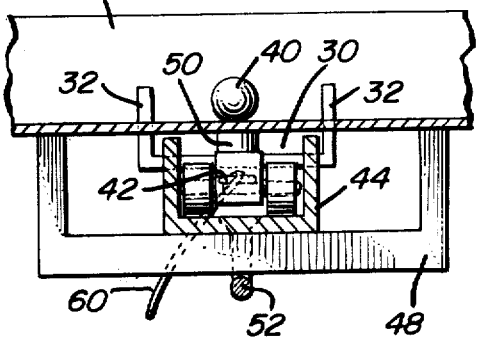
FIG. 5 is an elevational sectional view of the pitching device taken substantially along section 5—5 of FIG. 3.

A ferrous metal ball 40 is propelled toward home plate during the pitching procedure of the game by the use of a pitching apparatus as shown most clearly in FIGS. 2, 3 and 5. Therein it will be seen that a first cart-like device 42 is positioned upon a first track 44. Track 44 is pivotally attached at one end to a point directly beneath the pitcher's mound by stud 46 which both supports the track at that end and allows the opposite end of the track to sweep out an arc beneath home plate. An elongated support member 48 is positioned beneath the movable end of track 44 and provides vertical support therefor. It can be seen then that with track 44 extending between the pitcher's mound and home plate, if cart 42, carrying magnet 50, traverses the track beneath game board 12, ferrous metal ball 40, which is positioned on the pitcher's mound, will follow cart 42 toward home plate. Various degrees of angular orientation of track 44 may be produced by control rod 52 which extends from the rear of the game board as seen in FIGS. 1 and 4, under track 44 and forms a pivotal engagement with track 44 on the home plate end of that track. Consequently, any twisting motion imparted to the upturned part of control rod 52 as seen in FIG. 4 will cause lateral movement of the forward end of track 44. In this manner, the baseball 40 may be aimed at various parts of home plate 14 without the batter being able to determine the future trajectory of the ball. Also, if control rod 52 is actuate during movement of the ball, curvature of the path of the ball may be produced. A second track 54 has a second cart 56 placed on it. Cart 56 has a heavy weight 58 contained therein. Cart 56 is attached to cart 42 by a flexible string or wire 60. Wire 60 extends from the rear of cart 56 to guide 62 to the front of cart 42. Track 54 is suspended from the bottom of game board 12 by hinge 64. In this manner, the angle of track 54 may be varied with respect to the ground. A wedge 66 is disposed beneath the free end of track 54 and extends out of the rear control panel as seen in FIGS. 1 and 4. In this manner, the angle of track 54 may be varied by the defensive player by controlling the depth of insertion of wedge 66 into the control panel. In this manner, the speed of cart 56 may be controlled and, through wire 60, the speed of cart 42 will be varied in accordance with the angle of track 54. A wire 68 having control knob 70 attached thereto is connected to the rear of cart 42 and extends out of the control panel, as seen in FIG. 4. It will be evident that upon the rearward extension of wire 68 by pulling knob 70, carts 42 and 56 will be brought to their initial position whereupon ball 40 may be placed on the pitcher's mound. When a defensive player desires to pitch the ball, he simply releases knob 70 whereupon cart 42 coasts down track 54, thus pulling cart 42 and ball 40 toward home plate. The speed of the pitch may be adjusted by the use of wedge 66 while the angle of the trajectory may be controlled by rod 52. Thus, it may be seen that cart 56 advances to position 56' and cart 42 advances to position 42' as shown in FIGS. 2 and 3, while ball 40, due to the momentum gained by following magnet 50 breaks the magnetic hold at the position 40' and then advances to position 40".

Figure 7:
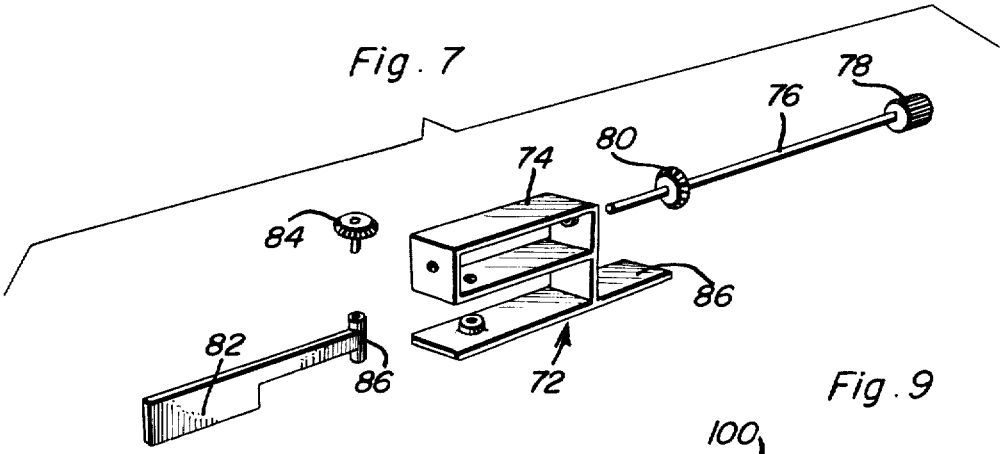
FIG. 7 is an exploded perspective view of the batting device of the present invention.
Figure 9:
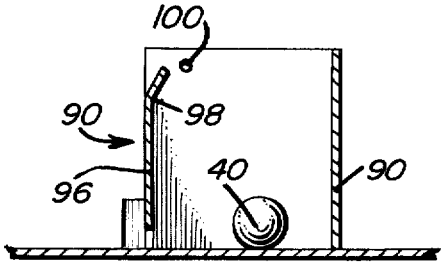
FIG. 9 is an elevational sectional side view of a fielding mechanism taken substantially along section line 9—9 of FIG. 8.
Figure 8:
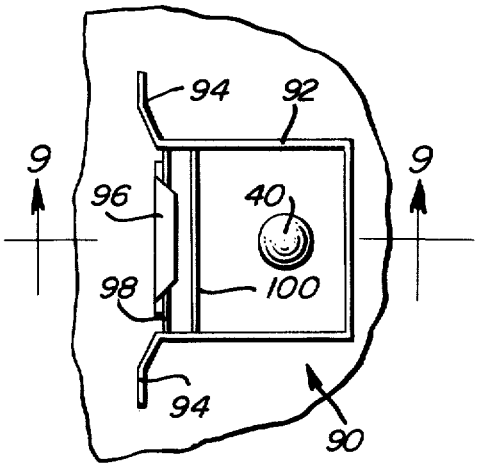
FIG. 8 is a plan view of a fielding mechanism of the present invention.
Figure 10:
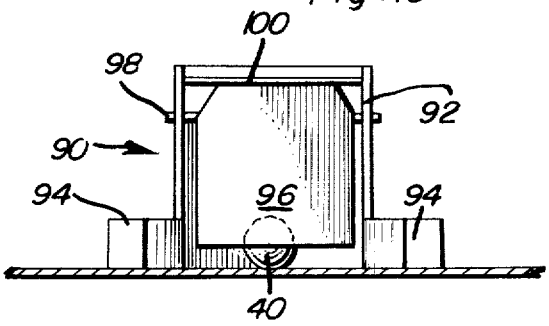
FIG. 10 is an elevational front view of a fielding mechanism of the present invention.

The offensive player has at his disposal a pitching mechanism generally designated by the numeral 72 as shown in FIGS. 1, 6 and 7. The pitching mechanism has a main frame 74. Disposed horizontally within the frame is a control rod 76. At one end of the control rod is a removable rubber knob 78 and toward the other end is a first, vertically oriented, bevel gear 80. A horizontally oriented bat 82 has a wide end section which extends for the width of the strike zone as is most apparent with reference to FIG. 6. Bat 82 also has an upstanding tubular collar in which a horizontal bevel gear 84 is press fitted. Bevel gear 84 coacts with bevel gear 80 to produce pivotal motion of bat 82 about the upstanding collar 86 when rotary motion is imparted to knob 78 by the offensive player. Frame 74 has as a part thereof a rearward extending tab 86. In use, the batting mechanism is positioned with control rod 76 extending through a hole provided therefor in wall 26 of the game board and tab 86 extending beneath the horizontally extending tab 88 of the game board. It will be noted that provision is made for either right-handed or left-handed use of the batting mechanism 72 by provision of identical tabs 88 extending toward home base from opposite sides of the game board. Also, holes are provided in wall 26 for the extension of rod 76 therethrough in either a right-handed or left-handed manner. This is clear with reference to FIG. 6 wherein a right-handed batting position is shown for mechanism 72, whereas a left-handed batting position is shown in phantom and labeled 72'.

Fielding mechanisms shown in FIGS. 1, 8, 9 and 10 are generally labeled by the numeral 90. Seven of these fielding mechanisms are provided, with one fielding mechanism being used to simulate each one of the fielders of a professional baseball team. Each fielding mechanism has a generally box-like frame structure 92 which has three closed sides and laterally extending projections 94 adjacent the open front. Covering the open front is a door-like member 96 which is pivotally engaged with the frame 92 by horizontally extending rod 98. A support rod 100 extends between two side walls to lend rigidity to the device. In operation, the device may catch the baseball by operation of the door 96 whereby the rolling baseball 40 will contact the lower part of door 96 pushing it upward and out of the way. Once inside, the force of the ball may be absorbed by the walls of the fielding mechanism. The ball may also be thrown by the device. With the ball stationary, the device is positioned with the lower portion of door 96 just to the rear of ball 40 whereupon the tab extending above rod 98 is pulled backward by the defensive player whereupon the ball is propelled in a forward direction.

The game is played using the same rules as used in professional baseball where possible. The defensive player positions the seven fielding mechanisms with three mechanisms in the outfield behind line 24 and four mechanisms in the infield behind line 22. Once placed in position, the fielding mechanisms may not be moved during the batting segment of the game. The ball is pitched by use of the pitching mechanism and swung at by batting mechanism 72 operated by the offensive player. If the ball engages one of the fielding mechanisms 90 and is trapped within that fielding mechanism it counts as an out. If the ball stops anywhere within the infield, but not within the confines of a fielding mechanism, the offensive player must be thrown out according to the rules of professional baseball. The defensive player may move a fielding mechanism 90 over first base and a second fielding mechanism 90 behind the stopped baseball whereupon he attempts to throw the player out by throwing the ball into the mechanism over first base. If the ball is trapped by the appropriate mechanism, the runner is out, otherwise the runner has the option of advancing to the next base, whereupon the procedure is again followed. Once a runner is safe on base and wishes to advance no further, this fact is indicated by use of the base running indicator 102 shown in FIG. 1 by the placement of a peg 104 within the appropriate hole in the indicator. If the hit ball advances to the outfield and stops forward of the nearest outfielder, it counts as a single. If the runner chooses to advance an additional base, the offensive player may throw him out at the next base according to the procedure discussed above. Once again, if the hit ball is caught by an outfield, the batter is out. If the hit ball advances past the nearest outfielder, it counts as a double and the runner once again has the option of attempting to advance to the next base. If the ball advances to bumper 28, and is deflected over wall 26 by the bumper, it counts as a home run. By the same token, if the deflected ball comes to rest within the area between the bumper and wall 26, the labelling within that area designates the number of bases to be advanced by the base runner, as will be apparent by inspection of FIG. 1.

It will be noted with reference to FIG. 1 that during the batting portion of the game, the only obstructions present on the field are the seven fielding mechanisms and the two foul ball markers. During fielding of the ball, the foul ball markers may be removed from the playing field leaving only the active fielding mechanism on the board. Likewise, the batting mechanism which is positioned under tab 88 to allow movement of the bat within the batting box may be removed at any time, in order to avoid obstructions when attempting to throw a man out at home.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for playing a game of the type in which a movable game piece is propelled across the game board and struck, said apparatus comprising:

a substantially planar game board;

a movable game piece;

propelling means for guiding said movable game piece across a portion of said game board;

striking means for use by a player for striking said movable game piece to cause it to move across said game board; and interception means for intercepting said movable game piece when it is in motion and imparting further motion to said movable game piece in a controlled direction;

said propelling means comprising a magnet movably mounted below said game board for movement on a pathway of fixed length; and said magnet being attached to a weight means which is movably mounted in a second pathway of fixed length, said second pathway being mounted to allow angular movement in a plane perpendicular to said game board.

2. The apparatus of claim 1 wherein said game board comprises a defined area over which the propelling means may guide said moveable game piece, and a depression located in relation to said defined area and walls extending above a portion of said depression whereby said movable game piece will enter the depression only after having crossed said defined area when guided by said propelling means.

3. The apparatus of claim 2 wherein said interception means consists of upstanding walls surrounding an interior space and a hinged door mounted on said walls to allow entry of said movable game piece to said interior space upon said game piece hitting against said door, and wherein said door is operative to impart motion to said game piece.

4. A tabletop baseball game comprising:

a game board having indications thereon describing a baseball diamond having a home plate, a first base, a second base, and a third base;

a pitching means for pitching a ball across home plate;

foul ball markers removably mounted to said game board for indicating foul balls;

a depression located behind game plate with walls extending above said depression wherein any pitched ball which enters said depression is considered a strike;

batting means operative to hit a pitched ball;

bumper means extending about the outfield operative to propel a moving batted ball off the game board to indicate a home run;

fielding mechanisms comprising upstanding vertical walls defining an interior space, a hinged door connected to said upstanding walls and operative to allow a moving ball to enter the interior space, said hinged door also operative to be moved by a player against the ball to impart motion to said ball in order to simulate throwing of said ball;

said pitching means comprising a first track disposed below said game board and pivotally mounted at one end beneath the pitcher's mound with the free end thereof capable of movement beneath home plate; a first cart positioned in said track for linear movement along said track; a magnet positioned in said first cart; a second track disposed below said game board and capable of variable vertical angular orientation, a second cart disposed for linear motion within said second track; means connecting said second cart to said first cart whereby motion of said second cart down said vertically oriented second track will impart motion of said first cart along said first track from the pitcher's mound in the direction of home plate; a magnetizable ball for positioning on said game board above said magnet; and means operative to change the angle of orientation of said second track whereby the speed of said first cart advancing from the pitcher's mound to home plate may be varied.

* * * * *